United States Patent [19]

Matsushima et al.

[11] Patent Number: 4,927,472

[45] Date of Patent: May 22, 1990

[54] CONVERSION COATING SOLUTION FOR TREATING METAL SURFACES

[75] Inventors: Yasunobu Matsushima; Shigeo Tanaka; Tomoyuki Aoki, all of Kanagawa; Yohji Ono, Tokyo, all of Japan

[73] Assignee: Nihon Parkerizing Co., Ltd., Tokyo, Japan

[21] Appl. No.: 256,935

[22] Filed: Oct. 13, 1988

[30] Foreign Application Priority Data

Oct. 13, 1987 [JP] Japan ..... 62-257678

[51] Int. Cl.[5] ..... C23C 22/14; C23C 22/23

[52] U.S. Cl. ..... 148/261

[58] Field of Search ..... 148/261

[56] References Cited

U.S. PATENT DOCUMENTS

| | | | |
|---|---|---|---|
| 2,930,723 | 3/1960 | Drysdale et al. | 148/6.15 |
| 3,530,012 | 9/1970 | Nakamura | 148/261 |
| 4,220,486 | 9/1980 | Matsushima | 148/261 |
| 4,306,917 | 12/1981 | Oda | 148/261 |

FOREIGN PATENT DOCUMENTS

| | | |
|---|---|---|
| 0974196 | 9/1960 | Fed. Rep. of Germany . |
| 1289759 | 2/1962 | France . |
| 2272192 | 2/1976 | France . |
| 2068418 | 12/1980 | United Kingdom . |

*Primary Examiner*—Sam Silverberg

*Attorney, Agent, or Firm*—Ernest G. Szoke; Wayne C. Jaeschke; Norvell E. Wisdom, Jr.

[57] ABSTRACT

A conversion coating, predominantly consisting of tin phosphate, can be deposited on steel or tin plated steel surfaces by contact with a solution containing phosphate ions, tin ions, an oxidizing agent such as chlorate, and a chelating agent for the tin ions, the latter to prevent the rapid loss of tin from the solution that otherwise would occur. A coating that confers excellent resistance to corrosion in hot water is formed on drawn and ironed thinly tin plated cans.

12 Claims, No Drawings

CONVERSION COATING SOLUTION FOR TREATING METAL SURFACES

FIELD OF THE INVENTION

The present invention relates to a conversion coating treatment solution for use in the conversion coating treatment of the surfaces of metals such as steel, galvanized steel sheet, tin-plate steel sheet, and the like, and particularly metal surfaces such as that generated by subjecting tin-plated steel sheet to drawing and ironing (hereinafter denoted as "DI surfaces", "DI cans", and the like, or simply as "DI"), often used for cans for beverages.

STATEMENT OF RELATED ART

U. S. Pat. No. 4,306,917 of Dec. 22, 1981 to Oda et al. teaches a non-chromate treatment solution for the formation of a predominantly tin phosphate conversion coating on the surfaces of metals such as steel, galvanized steel sheet, and tin-plated steel sheet, among others, and particularly on the surface of tin-plated DI cans. The conversion coating solution has a pH of 3–6 and contains 1–50 grams per liter (hereinafer "g/L") acid alkali phosphate as phosphate ion, 0.2–20 g/L of one or more salts selected from the bromates and chlorates, 0.01–0.5 g/L tin ion, and chloride ion in a weight ratio of 0.6–6.0 relative to the tin ion.

U. S. Pat. No. 4,220,486 of Sept. 2, 1980 to Matsushima et al. discloses a similar process with a more limited pH range and a solution including complex fluoride ions.

Treatment according to the teachings of either of these references initially affords an excellent anticorrosion coating on the surface of tin-plated DI cans. However, when tin-plated Di cans are subjected to a continuous conversion treatment using these methods, the treatment solution undergoes a gradual decline in tin ion concentration, resulting in a decline in conversion coating performance unless tin ions are replenished.

Furthermore, when such a conversion treatment solution is allowed to stand, the concentration of tin ions in the solution also gradually declines. As a consequence, an unsatisfactory coating is obtained when treatment is restarted after a long-term suspension of the line. This condition again requires replenishment of tin ion. Moreover, the production of tin-plated steel sheet only thinly coated with tin has recently developed in response to demands for economic efficiency, and the effective utilization of such steel sheet requires a conversion coating treatment solution that can provide excellent corrosion resistance. As a result, demand has arisen for a conversion treatment that will afford a corrosion resistance substantially better than that heretofore available.

DESCRIPTION OF THE INVENTION

Except for the operating examples, or where otherwise explicitly indicated, all numbers herein expressing quantities of ingredients or reaction conditions are to be understood as if prefaced by "about".

It has been found that a strongly anticorrosive coating can be formed reliably on the surfaces of metals such as steel sheet, galvanized steel sheet, tin-plated steel sheet, and the like, and particularly on the surface of tin-plated DI cans, by contact with an aqueous acid conversion coating solution comprising phosphate ions, tin ions, an oxidizing agent (alternatively called "accelerator"), and a chelating agent for tin ions. Preferably, the conversion coating solution according to this invention comprises an aqueous solution with a pH of 2–6 and containing 1–50 g/L phosphate ions, 0.2–20.0 g/L chlorate or bromate ions as the oxidizing agent, 0.01–5.0 g/L tin ions, and 0.01–5.0 g/L condensed phosphate ions, the latter serving as the chelating agent. More preferably, said condensed phosphate has the general formula $P_nO_{(3n+1)}$, where n=2, 3, or 4.

The invention has the following advantages:

(1) The chelating agent in the conversion treatment solution promotes sufficient dissolution of the metal surface undergoing treatment to generate an effective conversion coating at a practical rate. (With very age amounts of chelating agent, it is possible to promote excessively fast dissolution of the treated metal surface, so that an inadequate conversion coating is formed. Such large amounts should be avoided in the practice of the invention. With condensed phosphate ions as the chelating agent, this is the reason for the upper limit of 5.0 g/L.)

(2) Precipitation/deposition of tin ion from the conversion treatment solution is substantially reduced by its chelation bonding, while at the same time tin is still deposited as a component of the coating on the treated metal surface through the conversion reactions.

(3) Because a balance is maintained between introduction of tin ion into the treatment solution by dissolution of the treated metal and deposition of tin ions as a coating component, significant variation in the tin ion concentration in the treatment solution is avoided. This results in the formation of a consistent anticorrosion coating on the surface of the metal undergoing treatment.

Preferred sources of phosphate ions for the conversion coating solutions of this invention are sodium monohydrogen phosphate, potassium monohydrogen phosphate, ammonium monohydrogen phosphate, sodium dihydrogen phosphate, potassium dihydrogen phosphate, ammonium dihydrogen phosphate, or compounds prepared in situ from phosphoric acid and sodium hydroxide, potassium hydroxide, or ammonium hydroxide.

The concentration of phosphate ion preferably falls within the range of 1–50 g/L as phosphate ion, because the coating formed from solutions within these limits is more highly corrosion-resistant. Particularly good coatings are obtained from solutions within the range of 2–25 g/L in phosphate ion.

The oxidizing agent is preferably added in the form of sodium, potassium, or ammonium chlorate or bromate in a concentration within the range of 0.2–20 g/L, calculated as the oxyacid anion. At below 0.2 g/L, the rate of conversion coating may become impractically slow. On the other hand, a concentration in excess of 20 g/L accomplishes little or nothing to further increase the rate of conversion coating and increases expense and decreases the stability of the solution. Nitrites, such as sodium nitrite, or hydroxylamine salts can be used in place of all or part of the oxyacid ion in the conversion treatment solution of this invention.

Suitable tin ion sources are, for example, stannous chloride, stannic chloride, stannous sulfate, sodium stannate, and the like. The tin ion concentration (total concentration when both stannous and stannic ions are present) preferably falls within the range of 0.01–5 g/L. The conversion coating has a less effective anticorrosion performance when deposited from solutions with tin ion concentrations below 0.01 g/L, while exceeding 5 g/L not only does not result in an improvement in corrosion resistance, but also makes the treatment solution less stable.

As chelating agent for tin, the treatment solution of the present invention can effectively use any condensed phosphoric acid or condensed phosphate ion derived from such an acid. However, polyphosphate ions with the general formula $P_nO_{(3n+1)}$, where n=2, 3, or 4, are particularly preferred. Sodium, potassium, and ammonium salts of pyrophosphoric acid, tripolyphosphoric acid, and tetrapolyphosphoric acid can all be used as sources of polyphosphate ions with the above general formula. The concentration of this polyphosphate ion preferably falls within the range of 0.01–5.0 g/L. At below 0.01 g/L there is usually inadequate tin ion chelation. Tin ion chelation is normally saturated at above 5.0 g/L, and excess polyphosphate ions promote excessive dissolution of the metal being treated, which can undermine the conversion coat that it is desired to form.

Alternative chelating agents include phosphonic acids and organic acids such as tartaric acid, ascorbic acid, citric acid, gluconic acid, and the like.

The pH of the conversion coating treatment solution of the present invention is preferably adjusted to 2–6. This pH adjustment can be carried out using acids, such as phosphoric acid, hydrochloric acid, sulfuric acid, and the like or using bases such as sodium hydroxide, potassium hydroxide, ammonium hydroxide, and the like. The coating obtained with has lesser corrosion resistance when deposited from a solution at below pH 2. Furthermore, treating solution pH values in excess of 6 may result in loss of so much tin ion from the conversion treatment solution that the formation of high-quality conversion coatings is less likely.

The conversion coating treatment process according to this invention is preferably used a part of a sequence of steps as follows:

(1) Surface cleaning in weakly alkaline detergent
(2) Water rinse
(3) Use of the treatment solution of the present invention at a temperature from 15° to 90° C., most preferably from 50°–60° C., in order to speed the conversion reactions, by immersion or spraying for 10–120 seconds
(4) Water rinse
(5) Drying When the present invention is used on tin-plated steel strip, one advantageous variation that will lead to the formation of highly anticorrosive coatings while shortening tening the conversion time is cathodic electrolysis or alternating-current electrolysis using the tin-plated steel sheet as the cathode, a carbon plate, stainless steel plate, or other insoluble material as the counter-electrode, an inter-electrode distance of 10–500 mm, a current density of 0.05–10 amps per square decimeter, and a current flow duration of 0.5–60 seconds, with a treatment solution according to the present invention as electrolyte. The electrolytic treatment can be applied as the sole conversion coating used, or it can be applied after forming an initial coating by simple contact as described hereinabove.

While not wishing to be bound by any particular theory of the operation of the invention, the applicants believe that the chelating agent in their compositions functions to suppress the facile precipitation and deposition from the treatment solution to which unchelated tin ions are subject, due to hydrolysis and/or coprecipitation with iron ions generated by dissolution of the treated metal as a precipitate principally composed of tin hydroxide, tin phosphate and iron phosphate. Furthermore, by supplementing the etching activity of the phosphate ion, the chelating agent acts to make the course of the conversion reaction smoother, producing more uniform coatings than would otherwise be achieved. The conversion coatings produced by use of this invention, from the standpoints of corrosion resistance, bonding, and gloss, are excellent base coats for subsequent printing or coating.

The practice of the invention may be further understood from the following, non-limiting, operating examples and comparison example.

EXAMPLES 1–4 AND COMPARISION EXAMPLES 1–2

DI tin-plated steel sheet cans were cleaned using a hot 1% aqueous weakly alkaline degreaser (Fine Cleaner-43-61A from Nihon Parkerizing Company Limited). Conversion coating was conducted by then spraying the cans for 20 seconds with the solution specified below. The cans were then washed with tap water, sprayed for 10 seconds with deionized water (with at least 300,000 ohm cm of specific resistance), and dried in a hot air-circulation oven at 200° C. for 3 minutes. This conversion treatment process was conducted both immediately after bath preparation and after using the conversion treatment solution for treatment of 10 cans/-liter solution, followed by standing for one day. The tin ion concentration in the solution was measured in each case.

| Solution Composition and Temperature for Example 1 | |
|---|---|
| 75% $H_3PO_4$ | 15 g/L ($PO_4^{-3}$ 11 g/L) |
| $NaClO_3$ | 6 g/L |
| $SnCl_4.5H_2O$ | 0.6 g/L ($Sn^{+4}$ 0.2 g/L) |
| $Na_4P_2O_7.10H_2O$ | 1.5 g/L ($P_2O_7^{-4}$ 0.6 g/L) |
| pH = 3.1, adjusted with aqueous NaOH | |
| treatment solution temperature 60° C. | |

| Solution Composition and Temperature for Example 2 | |
|---|---|
| 75% $H_3PO_4$ | 2.8 g/L ($PO_4^{-3}$ 2 g/L) |
| $NaClO_3$ | 0.3 g/L |
| $SnCl_2.2H_2O$ | 0.04 g/L ($Sn^{+2}$ 0.02 g/L) |
| $Na_4P_2O_7.10H_2O$ | 0.05 g/L ($P_2O_7^{-4}$ 0.02 g/L) |
| pH = 5.7, adjusted with aqueous NaOH | |
| treatment solution temperature 70° C. | |

| Solution Composition and Temperature for Example 3 | |
|---|---|
| 75% $H_3PO_4$ | 55 g/L ($PO_4^{-3}$ 40 g/L) |
| $NaBrO_3$ | 17 g/L |
| $SnCl_4.5H_2O$ | 13.2 g/L ($Sn^{+4}$ 4.5 g/L) |
| $Na_5P_3O_{10}$ | 6.5 g/L ($P_3O_{10}^{-5}$ 4.5 g/L) |
| pH = 2.2, adjusted with aqueous NaOH | |
| treatment solution temperature 60° C. | |

| Solution Composition and Temperature for Example 4 | |
|---|---|
| 75% $H_3PO_4$ | 15 g/L ($PO_4^{-3}$ 11 g/L) |
| $NaClO_3$ | 6 g/L |
| $SnCl_2.2H_2O$ | 0.2 g/L ($Sn^{+2}$ 0.1 g/L) |
| $SnCl_4.5H_2O$ | 0.3 g/L ($Sn^{+4}$ 0.1 g/L) |
| $Na_6P_4O_{13}$ | 0.9 g/L ($P_4O_{13}^{-6}$ 0.6 g/L) |

-continued

| Solution Composition and Temperature for Example 4 |
|---|
| pH = 3.8, adjusted with aqueous NaOH<br>treatment solution temperature 60° C. |

| Solution Composition and Temperature for Comparison Example 1 | |
|---|---|
| 75% $H_3PO_4$ | 15 g/L $PO_4^{-3}$ 11 g/L) |
| $NaClO_3$ | 6 g/L |
| $SnCl_4.5H_2O$ | 0.6 g/L ($Sn^{+4}$ 0.2 g/L) |
| pH = 3.8, adjusted with aqueous NaOH<br>treatment solution temperature 60° C. | |

| Solution Composition and Temperature for Comparison Example 2 | |
|---|---|
| 75% $H_3PO_4$ 15 | g/L ($PO_4^{-3}$ 11 g/L) |
| $NaClO_3$ | 6 g/L |
| $SnCl_4.5H_2O$ | 0.6 g/L ($Sn^{+4}$ 0.2 g/L) |
| $Na_4P_2O_7.10H_2O$ | 21 g/L ($P_2O_7^{-4}$ 8 g/L) |
| pH = 3.1, adjusted with aqueous NaOH<br>treatment solution temperature 60° C. | |

The corrosion resistance of the cans produced in Examples 1–4 and Comparison Examples 1–2 was tested by immersing the treated cans in tap water at 60° C. for 30 minutes. The results are shown in Table 1, along with the concentrations of tin ions in the treating solutions (called "baths" for convenience).

TABLE 1

Results of Corrosion Resistance Tests and Tin Ion Analyzsis

| | Immediately After Bath Preparation | | After Bath Use to Treat Ten Cans Per Liter of Bath Volume, Then Standing One Day | |
|---|---|---|---|---|
| | Tin Ions Ppm in Bath | Red Rust Formation, % of Surface | Tin Ions; Ppm in Bath | Red Rust Formation; % of Surface |
| Examples | | | | |
| 1 | 200 | 0 | 200 | 0 |
| 2 | 20 | 8 | 20 | 8 |
| 3 | 4500 | 5 | 4500 | 5 |
| 4 | 200 | 0 | 200 | 0 |
| Comparison Examples | | | | |
| 1 | 200 | 10 | 0 | 100 |
| 2 | 200 | 20 | 200 | 20 |

The data in Table 1 show that the tin ion concentration is stable in all the solutions according to the present invention, whereas in Comparison Example 1, without any chelating agent for the tin ions, there was essentially no tin left in the solution after one day.

All the examples according to the invention produced some corrision resistance on the treated metal, as shown by comparison with the results after one day in Comparison Example 1: where there was no tin left in the solution before "treating" the cans, the entire surface was rusted. Comparison Example 2, with the chelating agent concentration above the preferred level, had stable tin ion concentration but formmed an unattractive and relatively ineffective conversion coating, while Examples 1 and 4 were the most effective in this group. All the Examples produced consistent results, as shown by comparison of the data for treatment immediately after solution preparation and one day later.

Tin-plated DI cans treated according to this invention were painted with an epoxy-urea can-grade paint to give a film thickness of 5–7 μm, followed by baking at 210° C. for 10 minutes, standing for 24 hours, immersion for 60 minutes in 1% aqueous citric acid heated to 95°–87° C., washing with water, and finally drying. In order to evaluate the peel resistance of the film, a cross was cut on the coated surface of a sample down to the metal substrate using a sharp knife, adhesive tape was pressed onto this using strong pressure, and the tape was then quickly peeled off. Absolutely no visible peeling was observed, indicative of excellent bonding.

While the description above has been in terms of solutions suitable for direct treatment of metal surfaces, it will be appreciated by those skilled in the art that it may often be more convenient to prepare the chemicals required in concentrated form for dilution with water at the point of use. Mixtures of dry chemicals or concentrated solutions of this type are also within the scope of this invention. Mixtures of more than one type, to be mixed together with or without dilution to form treatment solutions according to this invention, may also be prepared.

What is claimed is:

1. An aqueous solution for depositing a coating consisting predominantly of tin phosphate on an active metal surface in contact with said solution, comprising:

(a) from about 1 to about 50 grams per liter of orthophosphate ions;

(b) from about 0.2 to about 20 grams per liter of chlorate and bromate ions combined;

(c) a pH of about 2 to about 6;

(d) a total concentration of simple and chelated tin cations, measured stoichiometrically as tin only, of from about 0.01 to about 5.0 grams per liter; and (e) a concentration of condensed total phosphoric acid and ions derived therefrom, emasured stoichiometrically as maximally neutralized ions, of from about 0.01 to about 5 grams per liter, said condensed phosphoric acid having the general formula $H_{(n+2)}P_nO_{(3n+1)}$, wherein n=2, 3, or 4, said concentration of condensed total phosphoric acid and anions derived therefrom being effective to stabilize the soluble tin content of said solution against spontaneous diminution during storage out of contact with reactive surfaces for a period of one day.

2. A solution according to claim 1, wherein the concentration of orthophosphate ions is from about 2 to about 25 grams per liter.

3. A solution according to claim 6, wherein the concentration of orthophosphate ion is from about 9 to about 13 grams per liter, the concentration of tin cations is from about 0.15 to about 0.25 grams per liter, component (b) consists essentially of ions derived from sodium chlorate at a concentration of from about 4 to about 8 grams per liter, and the concentration of total phosphoric acid and anions derived therefrom is from about 0.7 to about 1.1 grams per liter.

4. A mixture of chemicals that can be converted into a solution according to claim 6 by dilution with water.

5. A mixture of chemicals that can be converted into a solution according to claim 6 by dilution with water.

6. A mixture of chemicals that can be converted into a solution according to claim 1 by dilution with water.

7. A process for forming a coating consisting predominantly of tin phosphate on a metal surface, comprising a step of contacting said metal surface, at a temperature between about 60° and about 70° C., with a solution comprising:

(a) from about 1 to about 50 grams per liter of orthophosphate ions;

(b) from about 0.2 to about 20 grams per liter of chlorate and bromate ions combined;

(c) a pH of about 2 to about 6;

(d) a total concentration of simple and chelated tin cations, measured stoichiometrically as tin only, of from about 0.01 to about 5.0 grams per liter; and (e) a concentration of condensed total phosphoric acid and anions derived therefrom, measured stoichiometrically as maximally neutralized ions, of from about 0.01 to about 5 grams per liter, said condensed phosphoric acid having the general formula $H_{(n+2)}P_nO_{(3n+1)}$, wherein n=2, 3, or 4, said concentration of condensed total phosphoric acid and anions derived therefrom being effective to stabilize the soluble tin content of said solution against spontaneous diminution during storage out of contact with reactive surfaces for a period of one day.

8. A process according to claim 15, wherein said oxidizing agent is chlorate or bromate ions or mixtures thereof.

9. A process according to claim 16, wherein said chelating agent comprises condensed phosphoric acids or ions derived therefrom.

10. A process according to claim 17, wherein said condensed phosphoric acid has the general formula $$H_{(n+2)}P_nO_{(3n+1)},$$

wherein n=2, 3, or 4.

11. A process according to claim 18, wherein the temperature of contact is between about 60° and about 70° C., and the concentration of said orthophosphate ion is from about 1 to about 50 grams per liter, the total concentration of simple and chelated tin anions, measured stoichiometrically as tin only, is from about 0.01 to about 5.0g rams per liter, the concentration of chlorate and bromate ions together is from about 0.2 to about 20 grams per liter, and the concentration of condensed phosphoric acid and ions derived therefrom, measured stoichiometrically as maximally neutralized ions, is from about 0.01 to about 5 grams per liter.

12. A process according to claim 15, whrein the concentration of orthophosphate ions is from about 9 to about 13 grams per liter, the concentration of tin ions is from about 0.15 to about 0.25 grams per liter, component (b) consists essentially of ions derived from sodium chlorate at a concentration of from about 4 to about 8 grams per liter, and the concentration of condensed total phosphoric acid and anions derived therefrom is from about 0.7 to about 1.1 grams per liter.

* * * * *

UNITED STATES PATENT AND TRADEMARK OFFICE

CERTIFICATE OF CORRECTION

PATENT NO. : 4,927,472

DATED : May 22, 1990

INVENTOR(S) : Matsushima et al.

It is certified that error appears in the above-identified patent and that said Letters Patent is hereby corrected as shown below:

In claim 3, column 6, line 54, claim 6 should read -- claim 2 --.

In claim 4, column 6, line 64, claim 7 should read -- claim 3 --.

In claim 5, column 6, line 66, claim 6 should read -- claim 2 --.

In claim 8, column 7, line 28, claim 15 should read -- claim 7 --.

In claim 9, column 8, line 1, claim 16 should read -- claim 8 --.

In claim 10, column 8, line 4, claim 17 should read -- claim 9 --.

In claim 11, column 8, line 9, claim 18 should read -- claim 10 --.

In claim 12, column 8, line 21, claim 15 should read -- claim 7 --.

Signed and Sealed this

Seventeenth Day of August, 1993

*Attest:*

Bruce Lehman

BRUCE LEHMAN

*Attesting Officer*

*Commissioner of Patents and Trademarks*